US005411851A

United States Patent [19]

Maskasky

[11] Patent Number: 5,411,851

[45] Date of Patent: May 2, 1995

[54] GRAIN GROWTH PROCESS FOR THE PREPARATION OF HIGH BROMIDE ULTRATHIN TABULAR GRAIN EMULSIONS

[75] Inventor: Joe E. Maskasky, Rochester, N.Y.

[73] Assignee: Eastman Kodak Company, Rochester, N.Y.

[21] Appl. No.: 195,807

[22] Filed: Feb. 14, 1994

[51] Int. Cl.[6] ..... G03C 1/07; G03C 1/035

[52] U.S. Cl. ..... 430/569; 430/567; 430/568

[58] Field of Search ..... 430/567, 569, 568

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,713,323 | 12/1987 | Maskasky | 430/569 |
| 4,914,014 | 4/1990 | Daubendiek et al. | 430/569 |
| 5,185,239 | 2/1993 | Maskasky | 430/569 |
| 5,217,858 | 6/1993 | Maskasky | 430/567 |
| 5,250,403 | 10/1993 | Antoniades et al. | 430/505 |
| 5,252,452 | 10/1993 | Chang et al. | 430/569 |

FOREIGN PATENT DOCUMENTS

| | | |
|---|---|---|
| 0362699 | 4/1990 | European Pat. Off. . |
| 0503700 | 9/1992 | European Pat. Off. . |

*Primary Examiner*—Charles L. Bowers, Jr.
*Assistant Examiner*—Mark F. Huff
*Attorney, Agent, or Firm*—Carl O. Thomas

[57] ABSTRACT

A grain growth process is disclosed for providing an ultrathin tabular grain emulsion in which the equivalent circular diameter of tabular grains is increased. An aqueous dispersion is provided containing high bromide seed grains having an average thickness of less or equal to that of the ultrathin tabular grains to be produced, the dispersion having a pH in the range of from 4.6 to 9.0 and a limited stoichiometric excess of bromide ions. An aminopyrimidine grain growth modifier containing mutually independent amino substituents, the 4 and 6 ring position substituents being hydroamino substituents, is introduced into the dispersing medium. The aqueous dispersion containing the aminopyrimidine grain growth modifier is held at room temperature or a convenient higher temperature until greater than 50 percent of total grain projected area is accounted for by ultrathin tabular grains having {111} major faces of a higher average equivalent circular diameter than the seed grains.

20 Claims, 3 Drawing Sheets

2 μm

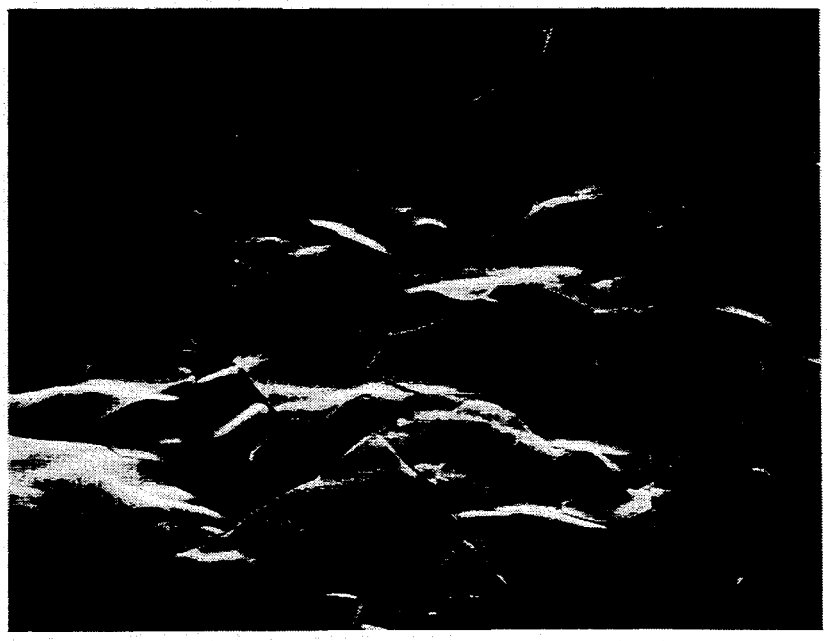
FIG. 1 2 μm
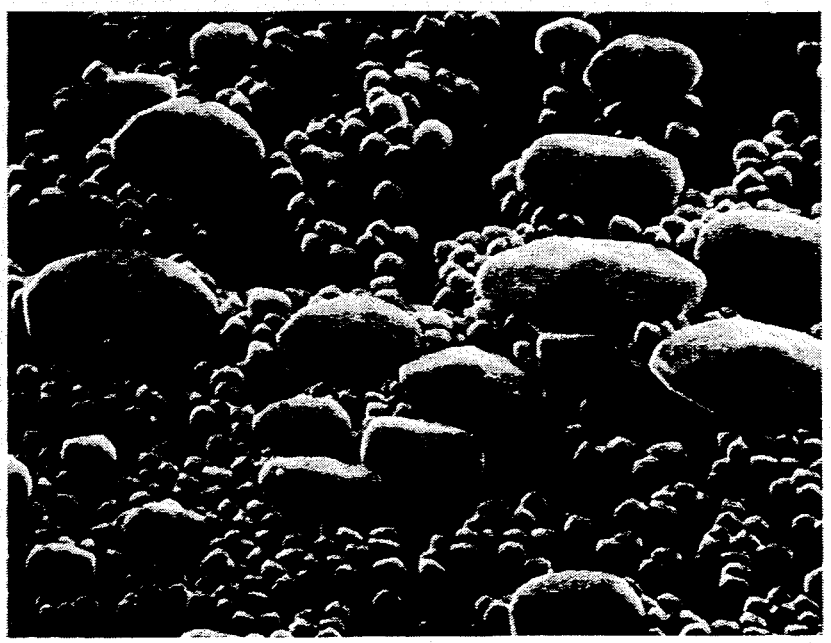
FIG. 2 1 μm

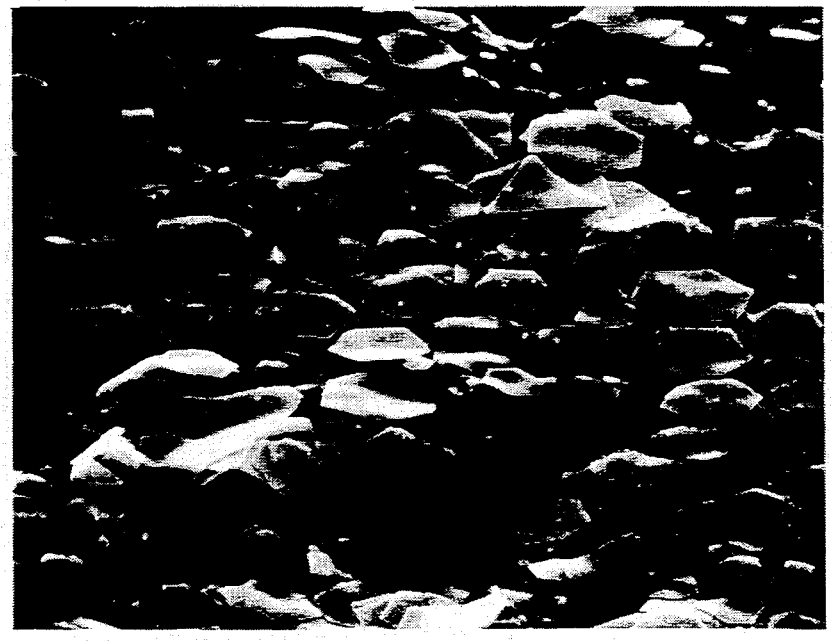
FIG. 3 2 μm
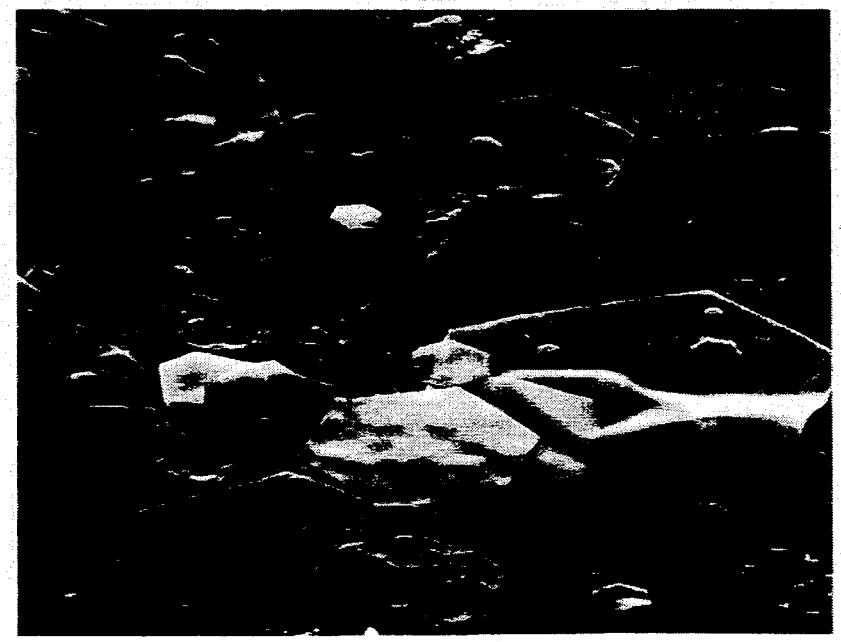
FIG. 4 4 μm

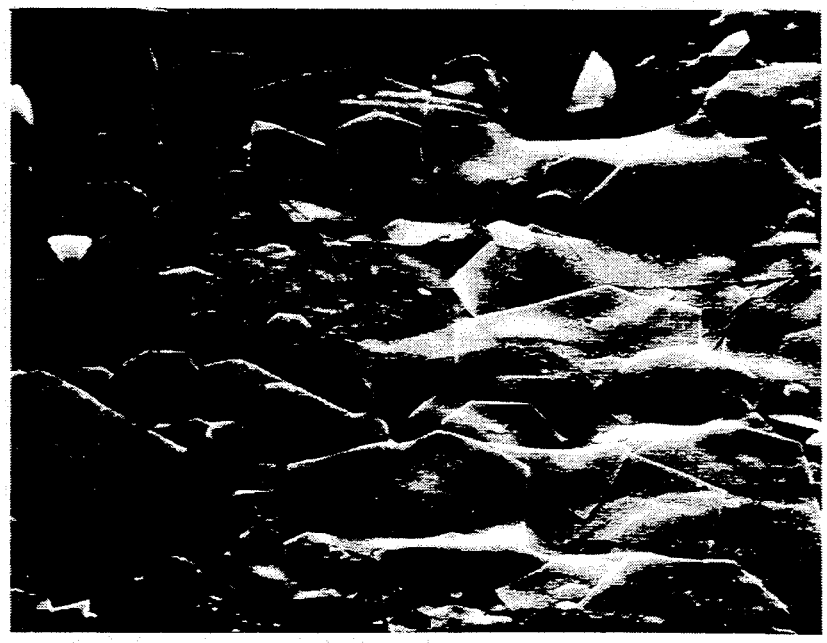
FIG. 5 4 μm
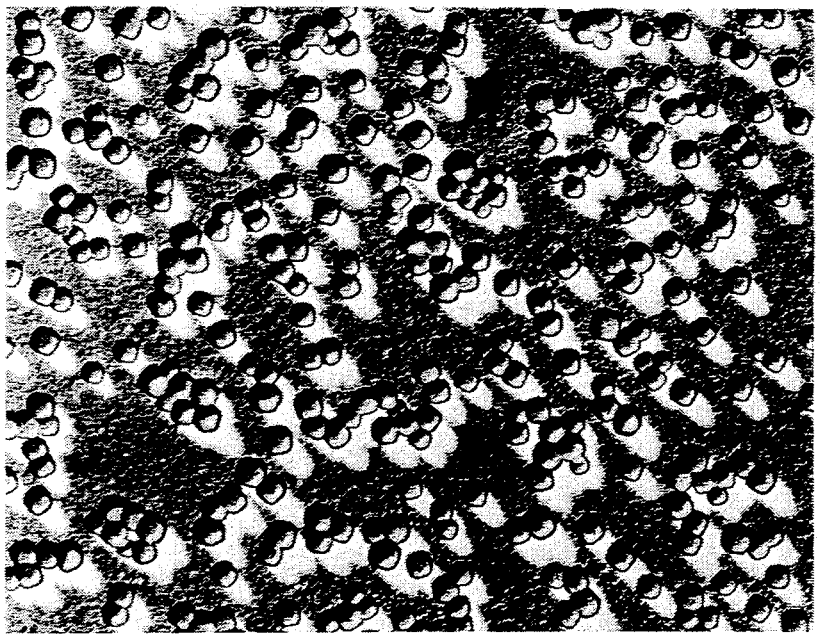
FIG. 6 0.5 μm

GRAIN GROWTH PROCESS FOR THE PREPARATION OF HIGH BROMIDE ULTRATHIN TABULAR GRAIN EMULSIONS

FIELD OF THE INVENTION

The invention relates to a grain growth process for preparing ultrathin high bromide tabular grain emulsions for photographic use.

BACKGROUND OF THE INVENTION

The term "tabular grain" is employed to indicate a silver halide grain having an aspect ratio of at least 2, where "aspect ratio" is ECD/t, ECD being the equivalent circular diameter of the grain (the diameter of a circle having the same projected area as the grain) and t is the thickness of the grain.

The term "ultrathin tabular grain" is employed to indicate a tabular grain of a thickness less than 0.07 μm.

The term "tabular grain emulsion" is employed to indicate an emulsion in which tabular grains account for at least 50 percent of total grain projected area.

The term "high chloride" or "high bromide" as applied to a grain or emulsion is employed to indicate that the grain or the grains of the emulsions contain at least 50 mole percent chloride or bromide, respectively, based on total silver present in the grain or the grains of the emulsion.

The term "{111} tabular grain" is employed to indicate an emulsion in which the parallel major faces of the tabular grain lie in {111} crystal planes.

The first high chloride high aspect ratio (ECD/t>8) {111} tabular grain emulsion is disclosed in Wey U.S. Pat. No. 4,399,215. The grains were relatively thick. Maskasky U.S. Pat. No. 4,400,463 (hereinafter designated Maskasky I) obtained thinner high chloride {111} tabular grains by employing an aminoazaindene (e.g., adenine) in combination with a synthetic peptizer having a thioether linkage. Maskasky U.S. Pat. No. 4,713,323 (hereinafter designated Maskasky II) produced thinner high chloride {111} tabular grains by employing the aminoazaindene grain growth modifier in combination with low methionine (<30 micromole per gram) gelatin, also referred to as "oxidized" gelatin, since the methionine concentration is reduced by employing a strong oxidizing agent, such as hydrogen peroxide.

High chloride ultrathin {111} tabular grain emulsions are disclosed in Maskasky U.S. Pat. No. 5,217,858 (hereinafter designated Maskasky III) and Maskasky U.S. Ser. No. 08/130,978, filed Oct. 4, 1993, titled ULTRATHIN HIGH CHLORIDE TABULAR GRAIN EMULSIONS, commonly assigned (hereinafter designated Maskasky IV).

Maskasky III discloses to be effective in preparing high chloride ultrathin {111} tabular grain emulsions triaminopyrimidine grain growth modifiers containing 4, 5 and 6 ring position amino substituents, with the 4 and 6 position substituents being hydroamino substituents. The term "hydroamino" designates an amino group containing at least one hydrogen substituent—i.e., a primary or secondary amino group. The triaminopyrimidine grain growth modifiers of Maskasky III include both those in which the three amino groups are independent (e.g., 4,5,6-triaminopyrimidine) and those in which the 5 position amino group shares a substituent with 4 or 6 position amino group to produce a bicyclic compound (e.g., adenine, 8-azaadenine, or 4-amino-7,8-dihydro-pteridine).

Maskasky IV discloses to be effective in preparing high chloride ultrathin tabular grain emulsions 7-azaindole type grain growth modifiers (e.g., 7-azaindole, 4,7-diazaindole, purine, 4-azabenzimidazole, 4,7-diazabenzimidazole, 4-azabenzotriazole, 4,7-diazabenzotriazole or 1,2,5,7-tetraazaindene).

The process which Maskasky III and IV employ to prepare high chloride ultrathin {111} tabular grain emulsions is a double jet process in which silver and chloride ions are concurrently run into a dispersing medium containing the grain growth modifier. The first function of the grain growth modifier is to promote twinning while grain nucleation is occurring, so that ultrathin grains can form. Thereafter the same grain growth modifier or another conventional grain growth modifier can be used to stabilize the {111} major faces of the high chloride tabular grains.

A common feature of the Maskasky high chloride {111} tabular grain emulsion precipitations is the presence of a grain growth modifier. The reason for this is that high chloride {111} tabular grains, unlike high bromide {111} tabular grains, cannot be formed or maintained in the absence of a grain growth modifier, but rather take nontabular forms, since {100} crystal faces are more stable in high chloride grains.

The art has long recognized that distinctly different techniques are required for preparing high chloride {111} tabular grain emulsions and high bromide {111} tabular grain emulsions. For example, Maskasky III and IV do not disclose the processes of preparing high chloride ultrathin {111} tabular grain emulsions to be applicable to the preparation of high bromide ultrathin {111} tabular grain emulsions. Further, since at low pBr the {111} major faces of high bromide tabular grains have no tendency to revert to {100} crystal faces, the precipitation of high bromide {111} tabular grain emulsions has not required the addition of compounds comparable to the grain growth modifiers of Maskasky.

Daubendiek et al U.S. Pat. No. 4,914,014, Antoniades et al U.S. Pat. No. 5,250,403 and Zola et al EPO 0 362 699 illustrate the preparation of high bromide ultrathin {111} tabular grain emulsions. Each of the Examples resulting in the formation of ultrathin tabular grain emulsions are replete with adjustments undertaken during precipitation. Typical complexities include (a) different pBr conditions for grain nucleation and growth, (b) interruptions of the silver and/or halide salt additions, (c) frequent modifications of the rate of silver and/or halide salt additions, (d) the use of separate reaction vessels for grain nucleation and growth, thereby at least doubling the complexity of reaction vessel and control equipment, (e) the variance in dispersing medium volume as precipitation progresses, which makes optimized reaction vessel sizing for all phases of precipitation impossible, (f) dilution of emulsion silver content as precipitation progresses toward completion, thereby creating a water removal burden and increasing the required capacity of the reaction vessel, and (g) when pBr is maintained at customary low (e.g., pBr<1.5) values employed for precipitating high bromide {111} tabular grain emulsions, large excess amounts of soluble bromide salts must be discarded. Note that since pBr is the negative logarithm of bromide ion activity, bromide ion concentrations increase as pBr decreases. This is directly analogous to hydrogen ion activity increasing as pH decreases. None of Antoniades, Daubendiek et al and Zola et al suggest the use of a grain growth modifier to prepare high bromide ultrathin {111} tabular grain emulsions.

Verbeeck EPO 0 503 700 discloses reduction of the coefficient of variation (COV) of high bromide high aspect ratio {111} tabular grain emulsions through the presence of an aminoazaindene, such as adenine, 4-aminopyrazolopyrimidine and substitutional derivatives, prior to the precipitation of 50 percent of the silver. Double jet precipitation techniques are employed. The minimum disclosed thickness of a tabular grain population is 0.15 μm.

SUMMARY OF THE INVENTION

In one aspect the invention is directed to a grain growth process for providing a tabular grain emulsion in which the equivalent circular diameter of tabular grains is increased while maintaining their thickness at less than 0.07 μm comprising (1) providing an aqueous dispersion containing at least 0.1 percent by weight silver in the form of silver halide seed grains containing at least 50 mole percent bromide having an average thickness of less than 0.06 μm, the dispersion having a pH in the range of from 4.6 to 9.0 and a stoichiometric excess of bromide ions to silver ions limited to a pBr of at least 1.5, (2) introducing into the dispersing medium a triaminopyrimidine grain growth modifier containing mutually independent 4, 5 and 6 ring position amino substituents, the 4 and 6 ring position substituents being hydroamino substituents, and (3) holding the aqueous dispersion containing the triaminopyrimidine grain growth modifier at a temperature of at least 15° C. until the average equivalent circular diameter of the seed grains remaining has increased at least 0.1 μm and greater than 50 percent of total grain projected area is accounted for tabular grains having {111} major faces and an average thickness of less than 0.07 μm.

The high bromide ultrathin {111} tabular grain emulsions prepared by the process of the invention included in the Examples below report thinner tabular grains than have heretofore been reported by the art in any emulsion preparation actually demonstrated. Thus, insofar as the quality of the grain population produced is concerned, the process of the invention compares favorably with prior processes for preparing high bromide ultrathin {111} tabular grain emulsions. At the same time, the process itself offers significant advantages over the double jet processes heretofore reported for preparing high bromide ultra-thin {111} tabular grain emulsions. All of the silver, halide and growth modifier can be present in the dispersing medium from the outset of grain growth. The volume of the reaction vessel can be constant and is almost always near constant throughout the growth process. The silver concentration levels can be relatively high. Water build up in the dispersing medium during the growth process does not occur and bromide ion concentration increases remain relatively small. A single reaction vessel can be employed for the growth process. Compared to the double jet procedures employed to prepare previously reported high bromide ultrathin {111} tabular grain emulsions it is apparent that the growth process of the invention is advantageous in allowing the use of simpler equipment, fewer controls, fewer and simpler manipulations, and the maintenance of higher silver concentrations in the dispersing medium, and in reducing halide ion effluent. Stated another way, all of the complexities (a) through (g) noted above can be either entirely obviated or significantly ameliorated.

BRIEF DESCRIPTION OF THE DRAWINGS

FIG. 1 is a scanning electron photomicrograph of the emulsion of Example 2 viewed at a 60° angle.

FIG. 2 is a scanning electron photomicrograph of the emulsion Control 1B viewed at a 60° angle.

FIG. 3 is a scanning electron photomicrograph of the emulsion of Example 7 viewed at a 60° angle.

FIGS. 4 and 5 are scanning electron photomicrographs of the emulsions of Examples 8 and 9, respectively.

FIG. 6 is a carbon replica electro photomicrograph of the emulsion of Control 10.

DESCRIPTION OF PREFERRED EMBODIMENTS

To satisfy the objective of a high bromide ultrathin {111} tabular grain emulsion as an end product the grain growth process of the invention can be practiced starting with any conventional high bromide silver halide emulsion in which the average grain thickness is less than 0.06 μm. The starting emulsion can be either a tabular grain emulsion or a nontabular grain emulsion.

In one application of the grain growth process of the invention a high bromide {111} tabular grain emulsion having a mean grain thickness of less than 0.06 μm is chosen as a starting material. One practical incentive for discontinuing whatever conventional precipitation process that was employed to originate the starting tabular grain emulsion is that there are numerous conventional techniques for producing ultrathin tabular grains while the mean ECD of the grain population remains quite small, but, unfortunately, if grain growth is continued, the discrimination between surface and edge growth is insufficient to prevent tabular grain thickening beyond the ultrathin region. The grain growth process of the invention offers the advantage, demonstrated in the Examples below, that tabular grain ECD can be increased at a much higher rate than the thickness of the tabular grains. Under even the most adverse conditions an incremental increase in the ECD of the tabular grains at least 10 times greater than the incremental increase of their thickness can be realized. That is, at least a 0.1 μm increase in ECD can be realized by the growth process of the invention before a 0.01 μm increase in tabular grain thickness occurs. In fact, as demonstrated in the Examples below, extremely large increases in mean ECD in starting tabular grains can be realized while maintaining thickness increases well below 0.01 μm. From these demonstrations it is apparent that, if the starting tabular grains have a thickness of less than 0.06 μm, it is possible to increase their mean ECD to any useful size. That is, mean ECD can be increased to 5 μm or even to the 10 μm commonly accepted maximum mean ECD useful limit for photographic purposes without exceeding the ultrathin thickness limit of $<0.07$ μm. Since the grain growth process of the invention has the effect of increasing the percentage of total grain projected area accounted for by tabular grains, any high bromide tabular grain starting emulsion can be employed that satisfies the minimum projected area to satisfy the tabular grain emulsion definition (i.e., tabular grains accounting for at least 50 percent of total grain projected area).

To provide a specific illustration of how the grain growth process of the invention can be applied, attention is directed to Tsaur et al U.S. Pat. No. 5,210,013, which discloses the preparation of high bromide {111} tabular grain emulsions in which the COV is less than 10 percent and substantially all of the grain projected area is accounted for by tabular grains. Unfortunately, the process of preparation employed by Tsaur et al thickens the tabular grains. A minimum mean tabular grain thickness of 0.08 μm is disclosed. By initiating tabular grain emulsion preparation employing the process of Tsuar et al and then completing grain growth with the process of the present invention it is possible to initiate tabular grain preparation as taught by Tsaur et al while still obtaining an ultrathin tabular grain emulsion.

Another preferred approach that, together with the approach above, illustrates the breadth of the invention is to choose as a starting emulsion for the grain growth process a high bromide Lippmann emulsion. The term "Lippmann emulsion" has historically been applied to emulsions in which the grain sizes are too small to scatter visible light. Thus, the emulsions are visually identifiable as being nonturbid. A typical Lippmann emulsion grain size is around 500 Å or less. The grain population is, of course, entirely nontabular. The Examples below demonstrate the practice of the invention starting with the precipitation of a Lippmann emulsion.

Having demonstrated the extremes of the starting grain populations to which the grain growth process can be applied, it is apparent that the grain growth process of the invention can also be practiced with intermediate starting emulsions. That is, so long as mean grain thickness remains less than 0.06 μm it is immaterial whether the grains in the starting emulsion are entirely nontabular (all grains having aspect ratios of less than 2), entirely tabular or a mixture of both. Any conventional high bromide silver halide emulsion preparation process can be applied to the preparation of a seed grain population for use in the grain growth process of the invention. Conventional emulsion preparation processes that produce fine nontabular grains or ultrathin tabular grains can be employed without modification while precipitation processes that would otherwise produce grains exceeding the 0.06 μm grain thickness parameter can simply be brought to an earlier termination to stay within this grain size limit.

The seed grains provided by the starting emulsion can be pure bromide or can contain minor amounts of chloride and/or iodide. Silver chloride can be present in the high bromide seed grains in any concentration up to, but less than 50 mole percent. The incorporation of chloride in high bromide seed grains can be used to reduce native blue sensitivity and to increase photographic development rates. Preferred chloride ion concentration levels in the seed grains are less than 25 mole percent. The solubility limit of iodide ions in silver bromide varies, depending upon precipitation conditions, but is rarely greater than 40 mole percent, while typical iodide concentrations in photographic emulsions are less than 20 mole percent. Extremely low levels of iodide in silver bromide, as low as 0.01 mole percent, can produce detectable increases in photographic sensitivity. Since iodide slows photographic processing rates and is not required in high concentrations to enhance photographic sensitivity, it is usually preferred to limit the iodide content of the seed grains to less than 10 mole percent and, for rapid processing applications, to less than 5 mole percent. The seed grains can be silver bromide, silver iodobromide, silver chlorobromide, silver iodochlorobromide or silver chloroiodobromide grains, where halides are named in order of ascending concentrations. It is also possible to introduce each different halide in a separate grain population. For example, the iodide ions can be supplied by introducing with silver bromide seed grains a separate silver iodide Lippmann emulsion. As grain growth occurs grains emerge that contain the desired mixture of halides. By timing the addition of a separate halide it is also possible to control the profile of that halide within the grains being grown.

The seed grains, apart from the required features described above, can take any convenient conventional form.

Starting with a conventional high bromide emulsion of the type described above an aqueous dispersion is prepared containing at least 0.1 percent by weight silver, based on total weight, in the form of the seed grains supplied by the starting emulsion. The weight of silver in the dispersing medium can range up to 20 percent by weight, based on total weight, but is preferably in the range of from 0.5 to 10 percent by weight, based on the total weight of the dispersion.

The aqueous dispersion also receives the water and peptizer that are present with the seed grains in the starting emulsion. The peptizer typically constitutes from about 1 to 6 percent by weight, based on the total weight of the aqueous dispersion. In the simplest mode of practicing the invention, the grain growth process of the invention is undertaken promptly upon completing precipitation of the seed grain emulsion, and only minimum required adjustments of the dispersing medium of the seed grain emulsion are undertaken to satisfy the aqueous dispersion requirements of the grain growth process. This is particularly advantageous where the seed grains are susceptible to ripening, as in a Lippmann emulsion. Where the stability of the precipitated seed grain population permits, intermediate steps, such as washing, prior to commencing the grain growth process are not precluded.

The pH of the aqueous dispersion employed in the grain growth process is in the range of from 4.6 to 9.0, preferably 5.0 to 8.0. Adjustment of pH, if required, can be undertaken using a strong mineral base, such as an alkali hydroxide, or a strong mineral acid, such as nitric acid or sulfuric acid. If the pH is adjusted to the basic side of neutrality, the use of ammonium hydroxide should be avoided, since under alkaline conditions the ammonium ion acts as a ripening agent and will increase grain thickness.

To minimize the risk of elevated minimum densities in the emulsions prepared, it is common practice to prepare photographic emulsions with a slight stoichiometric excess of bromide ion is present. At equilibrium the following relationship exists:

$$-\log K_{sp} = pBr + pAg \quad (I)$$

where $K_{sp}$ is the solubility product constant of silver bromide;

pBr is the negative logarithm of bromide ion activity; and pAg is the negative logarithm of silver ion activity.

The solubility product constant of silver bromide emulsions in the temperature range of from 0° to 100° C. has been published by Mees and James *The Theory of the Photographic Process*, 3th Ed., Macmillan, New York, 1966, page 6. The equivalence point, pBr=pAg=−log $K_{sp} \div 2$, which is the point at which no stoichiometric excess of bromide ion is present in the aqueous dispersion, is known from the solubility product constant. By employing a reference electrode and a sensing electrode, such as a silver ion or bromide ion sensing electrode or both, it is possible to determine from the potential measurement of the aqueous dispersion its bromide ion content (pBr). Lin et al U.S. Pat. No. 5,317,521, is here incorporated by reference to show electrode selections and techniques for monitoring pBr. To avoid unnecessarily high bromide ion concentrations in the aqueous dispersion (and hence unnecessary waste of materials) the pBr of the aqueous dispersion is adjusted to at least 1.5, preferably at least 2.0 and optimally greater than 2.6. Soluble bromide salt (e.g. alkali bromide) addition can be used to decrease pBr while soluble silver salt (e.g. silver nitrate) additions can be used to increase pBr.

To the aqueous dispersion, either before, during or following the pBr and pH adjustments indicated, is added a triaminopyrimidine grain growth modifier containing mutually independent 4, 5 and 6 ring position amino substituents, with the 4 and 6 ring position substituents being hydroamino substituents. As employed herein the term "hydroamino" designates an amino group containing at least one hydrogen substituent—i.e., a primary or secondary amino group. The 5 position amino ring substituent can be a primary, secondary or tertiary amino group. In referring to the amino groups as "independent" it is meant that each amino group can be selected independently of the others and that no substituent of one amino group is shared with another amino group. In other words, substituents that bridge amino groups are excluded. Pyrimidine grain growth modifiers satisfying the above general description are herein referred to as "invention" grain growth modifiers.

In a specifically preferred form the grain growth modifier can satisfy the following formula:

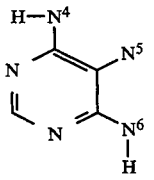

(II)

where $N^4$, $N^5$ and $N^6$ are independent amino moieties.

In the simplest contemplated form each of $N^4$, $N^5$ and $N^6$ can be a primary amino group (—$NH_2$). Any one or combination of $N^4$, $N^5$ and $N^6$ can be a primary amino group. Any one or combination of $N^4$, $N^5$ and $N^6$ can alternatively take the form of a secondary amino group (—NHR), where the substituent R is in each instance an independently chosen hydrocarbon containing from 1 to 7 carbon atoms. R is preferably an alkyl group—e.g., methyl, ethyl, n-propyl, i-propyl, n-butyl, i-butyl, t-butyl, etc., although other hydrocarbons, such as cyclohexyl or benzyl, are contemplated. To increase growth modifier solubility the hydrocarbon groups can, in turn, be substituted with polar groups, such as hydroxy, sulfonyl or amino groups, if desired, or the hydrocarbon can be substituted with other groups that do not materially affect their properties (e.g., a halo substituent). In another alternative form $N^5$ can, independently of $N^4$ and $N^6$, take the form of a tertiary amino group (—$NR_2$), where R is as previously defined.

In one specific form the grain growth modifiers of this invention satisfy the formula:

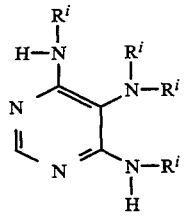

(III)

where $R^i$ is independently in each occurrence hydrogen or alkyl of from 1 to 6 carbon atoms.

The following are illustrations of varied pyrimidine compounds within the purview of the invention:

4,5,6-Triaminopyrimidine PY-1

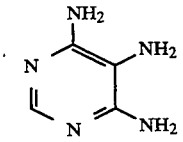

5,6-Diamino-4-(N-methylamino)pyrimidine PY-2

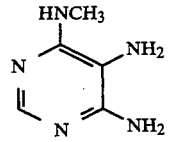

4,5,6-Tri(N-methylamino)pyrimidine PY-3

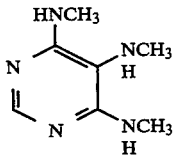

4,6-Diamino-5-(N,N-dimethylamino)pyrimidine PY-4

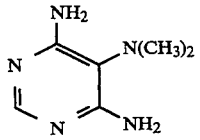

4,6-Diamino-5-(N-hexylamino)pyrimidine PY-5

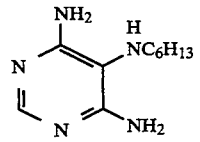

One of the surprising discoveries has been that grain growth modifiers that function similarly as the triaminopyrimidines of the invention when employed in the preparation of high chloride {111} tabular grain emulsions are not effective when substituted for the grain growth modifiers of the invention in the grain growth process of this invention. A further surprising observation is that the grain growth modifiers of the invention are also ineffective to produce high bromide ultrathin {111} tabular grain emulsions during a double jet precipitation process.

It is believed that the effectiveness of the grain growth modifier is attributable to its preferential absorption to {111} crystal faces and its ability to preclude additional silver halide deposition on these surfaces. Actual observations indicate that the interactions between the various grain surfaces present in the aqueous dispersion and the grain growth modifier are, in fact, complex. For example, it is not understood why double jet precipitations employing the grain growth modifier are less effective than the grain growth process of the invention. Contemplated concentrations of the grain growth modifier for use in the grain growth process of the invention range from 0.1 to 500 millimoles per silver mole. A preferred grain growth modifier concentration is from 0.4 to 200 millimoles per silver mole, and an optimum grain growth modifier concentration is from 4 to 100 millimoles per silver mole.

Once the grain growth has been introduced into the aqueous dispersion a high bromide ultrathin {111} tabular grain emulsion is produced by holding the aqueous dispersion at any convenient temperature known to be compatible with grain ripening. This can range from about room temperature (e.g., 15° C.) up to the highest temperatures conveniently employed in silver halide emulsion preparation, typically up to about 90° C. A preferred holding temperature is in the range of from about 20° to 80° C., optimally from 35° to 70° C.

The holding period will vary widely, depending upon the seed grain population, the temperature of holding and the objective sought to be maintained. For example starting with a high bromide ultrathin {111} tabular grain emulsion to provide the seed grain population with the objective of increasing mean ECD by a minimum 0.1 μm, a holding period of no more than a few minutes may be necessary in the 30° to 60° C. temperature range, with even shorter holding times being feasible at increased holding temperatures. On the other hand, if the seed grain population consists entirely of fine grains and the intention is to continue the growth process until the fine grains have been entirely eliminated from the emulsion, holding periods can range from few minutes at the highest contemplated holding temperatures to overnight (16 to 24 hours) at ambient temperatures. The holding period is generally comparable to run times employed in preparing high bromide ultrathin {111} tabular grain emulsions by double jet precipitation techniques when the temperatures employed are similar. The holding period can be shortened by the introduction into the aqueous dispersion of a ripening agent of a type known to be compatible with obtaining thin (less than 0.2 μm mean grain thickness) tabular grain emulsions, such as thiocyanate or thioether ripening agents.

The grain growth process of the present invention is capable of providing high bromide ultra-thin {111} tabular grain emulsions having precisely selected mean ECD's. The emulsions can also exhibit high levels of grain uniformity. Attaining emulsions in which the tabular grains account for greater than 70 percent of total grain projected area can be readily realized and with typical seed grain populations tabular grain projected areas accounting for greater than 90 percent of total grain projected area have been realized.

Since the {111} major faces of high bromide {111} tabular grains, unlike those of high chloride {111} tabular grains, are stable and do not require adsorbed species to avoid degradation to unwanted grain morphologies, it is recognized that the grain growth modifier of the invention can be removed following completion of the grain growth process. The grain growth modifier of the invention can be removed by protonation. It is not necessary, but preferred for most photographic end uses, that the grain growth modifier be replaced on the {111} major faces of the tabular grains by another, photographically useful adsorbed compound, such as a spectral sensitizing dye. Protonation alone or protonation followed by adsorption of another photographically useful compound can be undertaken as disclosed by Maskasky U.S. Pat. No. 5,221,602, here incorporated by reference, (hereinafter designated Maskasky V).

During their preparation and subsequently conventional adjustments of the photographic emulsions can be undertaken. Conventional features are summarized in *Research Disclosure*, Vol. 308, Dec. 1989, Item 308119, the disclosure of which is here incorporated by reference. *Research Disclosure* is published by Kenneth Mason Publications, Ltd., Dudley House, 12 North St., Emsworth, Hampshire P010 7DQ, England.

EXAMPLES

The invention can be better appreciated by reference to the following specific embodiments.

Example 1

Testing Compounds as Tabular Grain Growth Enhancers

Emulsion A. Fine Grain AgBr Emulsion

To a stirred reaction vessel containing 2 L of distilled water containing 5 percent by weight gelatin, based on total weight, at 35° C. were added 2M $AgNO_3$ solution and 2M NaBr solution. The $AgNO_3$ solution was added at 300 mL/min and the NaBr solution was added as needed to maintain a pBr of 3.63. A total of 0.6 mole of $AgNO_3$ was added.

Emulsion B. AgBr Seed Tabular Grain Emulsion

To a stirred reaction vessel containing 7.5 g of oxidized (<30 micromoles methionine per gram) gelatin, 1.39 g NaBr and distilled water to 2L. At 35° C. and pH 2.0, 10 mL of 2M $AgNO_3$ solution were added at 50 mL/min. Concurrently, 2M NaBr solution was added to maintain a pBr of 2.21. The temperature was increased to 60° C. at a rate of 5° C. per 3 minute interval. Then 150 mL of distilled water containing oxidized gelatin in the amount of 33 percent by weight, based on total weight, at 60° C. were added and the pH adjusted to 6.0 and 14 mL of a 2M NaBr solution was added. At 60° C. and pH 6.0, 500 mL of a 2M $AgNO_3$ solution were added at 20 mL/min. Concurrently, 2M NaBr solution was added to maintain a pBr of 1.76. The resulting tabular seed grains were 1.3 μm in diameter and 0.04 μm in thickness.

Grain Growth Testing

At 40° C. to 0.021 mole Emulsion A was added with stirring, 0.0032 mole Emulsion B. The pBr was adjusted to 3.55. A solution of the potential tabular grain growth modifier was added in the amount of 7.0 mmole/mole Ag. The mixture was adjusted to a pH of 6.0 then heated to 70° C. and the pH was again adjusted to 6.0. After heating for 17 hours at 70° C., the resulting emulsions were examined for ultrathin tabular grains by optical and electron microscopy to determine mean diameter and thickness. The results are given in Table I.

TABLE 1

| Emulsion | Potential Tabular Grain Growth Modifier | Average Tabular Grain Dimensions | Tabular Grain % Projected Area |
|---|---|---|---|
| Control 1A | none | 1.7 μm × 0.18 μm | 60% |
| Control 1B | adenine | 1.3 μm × >0.20 μm | 40% |
| Example 1C | 4,5,6-triaminopyrimidine | 4.3 μm × 0.042 μm | >95% |
| Control 1D | xanthine | 1.3 μm × 0.20 μm | 40% |
| Control 1E | 4-aminopyrazolo[3,4-d]pyrimidine | 2.0 μm × 0.20 μm | 90% |

As the above results show, only Example Emulsion 1C (4,5,6-triaminopyrimidine) yielded an ultrathin tabular grain emulsion. This emulsion had greater than 95% of total grain projected area accounted for by tabular grains. The control, Control Emulsion 1A, with no added tabular grain growth modifier, resulted in only minor lateral growth and significant thickness growth.

Example 2

AgBr Ultrathin Tabular Grain Emulsion

To a stirred reaction vessel containing 50 g oxidized gelatin and 2 L distilled water at 25° C. were added 300 mL of 2M $AgNO_3$ solution at a rate of 300 mL per/minute. A 2M NaBr solution was simultaneously added at a rate needed to maintain a pBr of 3.82.

To 90 g of the resulting AgBr Lippmann emulsion at 25° C. were added 4 mL of an aqueous solution containing a total of 16 mmole per mole silver of 4,5,6-triaminopyimidine. The temperature was increased to 40° C. after which the pH was adjusted to 7.0 and the pBr to 2.57. The mixture was heated to 60° C., and the pH and pBr were adjusted to 7.0 and 2.32, respectively. The emulsion was heated for 1 hour at 60° C. resulting in a tabular grain emulsion.

The mean grain thickness of the tabular grain emulsion was obtained by scanning 1159 tabular grains using atomic force microscopy (AFM) to obtain an average tabular grain thickness and adsorbed gelatin layer thickness. The measured gelatin thickness of 0.0035 μm was subtracted from this value. The corrected average thickness was 0.024 μm. The mean ECD was 2.1 μm, determined from electron microscopy of 1071 grains. The mean aspect ratio of the grains was 88. The tabular grain population was greater than 95% of the projected area of the emulsion grains. The results are tabulated in Table II.

Example 3

AgBr Ultrathin Tabular Grain Emulsion

This example was made similar to that of Example 2, except that the seed grain emulsion was precipitated using 25 g of oxidized gelatin at 15° C. and maintaining a pBr of 3.15.

The resulting tabular grain emulsion contained tabular grains having an average ECD of 0.70 μm, an average thickness (AFM) of 0.022 μm, an average aspect ratio of 32. The tabular grains accounted for greater than 95% of the projected area of the emulsion grains. The results are tabulated in Table II.

Example 4

AgBr Ultrathin Tabular Grain Emulsion

This example employed an emulsion preparation procedure similar to that of Example 2, except that 900 mL of 2M $AgNO_3$ solution were added at a rate of 300 mL per/minute. The amount of 4,5,6-triaminopyrimidine used was 7.9 mmole per mole silver, and the mixture was heated for 2 hours at 60° C.

The resulting tabular grain emulsion contained tabular grains having an average ECD of 10.0 μm, an average thickness of 0.035 μm, and an average aspect ratio of 286. Greater than 95% of the total grain projected area was accounted for by tabular grains. The results are tabulated in Table II.

Example 5

AgBr Ultrathin Tabular Grain Emulsion

This example was prepared by a procedure similar to that of Example 2, except for changes in the pH and pBr for the growth of the fine grain emulsion. At 40° C., a mixture of the fine grain emulsion and triaminopyrimidine solution was adjusted to pH 6.0 and pBr 3.38. The mixture was heated to 60° C., and the pH and pBr were adjusted to 6.0 and 3.08, respectively. The emulsion was heated for 1 hour at 60° C.

The resulting emulsion contained tabular grains having an average ECD of 2.0 μm, an average thickness of 0.026 μm and an average aspect ratio of 77. The tabular grains accounted for greater than 95% of the projected area of the emulsion grains. The results are tabulated in Table II.

Example 6

AgBr Ultrathin Tabular Grain Emulsion

To a stirred reaction vessel containing 50 g oxidized gelatin and 2 L distilled water at 25° C. were added 200 mL of a 1M $AgNO_3$ solution at a rate of 300 mL per/minute. A 1M NaBr solution was simultaneously added at a rate needed to maintain a constant pBr of 3.82.

To 90 g of the resulting AgBr Lippmann emulsion at 25° C. were added 1.5 mL of an aqueous solution containing a total of 16.9 mmole per mole silver of 4,5,6-triaminopyrimidine. The temperature was increased to 40° C., and the pH and pBr were adjusted to 7.0 and 2.57, respectively. The mixture was heated to 60° C., and the pH and pBr were adjusted to 7.0 and 2.32, respectively. The emulsion was heated for 1 hour at 60° C., resulting in a tabular grain emulsion.

The resulting emulsion contained tabular grains having an average ECD of 1.61 μm, an average thickness (AFM) of 0.022 μm, and an average aspect ratio of 73. Tabular grains accounted for greater than 95% of the total grain projected area. The results are tabulated in Table II.

Example 7

AgIBr Ultrathin Tabular Grain Emulsion

This example was prepared by a procedure similar to that of Example 5, except that the 2M NaBr solution was replaced by a solution containing 1.94M NaBr and 0.06M KI. The fine grain emulsion and triaminopyrimidine were heated at pH 7.0, pBr 3.38 for 1.5 hours at 60° C.

The resulting tabular grain emulsion contained tabular grains having an average ECD of 1.33 μm, an average thickness of 0.030 μm (AFM), and an average aspect ratio of 44. The tabular grains accounted for greater than 95% of the total grain projected area of the emulsion grains. The results are tabulated in Table II.

The amount of iodide incorporated into the tabular grains was determined using x-ray powder diffraction. Iodide in the amount of 3.1 mole % was distributed homogeneously throughout the tabular grains.

Example 8

AgClBr Ultrathin Tabular Grain Emulsion

A stirred reaction vessel containing 50 g oxidized gelatin and 2 L distilled water at 25° C. was adjusted to a pBr of 3.82 with NaBr solution (+100 mV using a Ag sensing electrode and a standard Ag/AgCl reference electrode). Then 300 mL of 2M $AgNO_3$ solution were added at a rate of 300 mL per/minute, and a solution that was 1.6M in NaBr and 0.544M in NaCl was simultaneously added at a rate needed to maintain the +100 mV. A total of 310 mL of this solution was used.

To 90 g of the resulting emulsion at 25° C. were added 12.1 mmole per mole silver of 4,5,6-triaminopyrimidine. The temperature was raised to 40° C. and the pH was adjusted to 7.0. The vAg was adjusted to +100 mV with NaCl solution. The mixture was heated to 60° C. and the pH was adjusted to 7.0. The vAg was adjusted to +100 mV with NaCl solution. The emulsion was heated for 1.5 hours at 60° C.

The resulting tabular grain emulsion contained tabular grains having an average diameter of 5.84 νm, an average thickness of 0.033 μm (AFM) and an average aspect ratio of 177. The tabular grains accounted for greater than 95% of the projected area of the emulsion grains. The results are tabulated in Table II.

The amount of silver chloride incorporated into the silver halide grain lattice was determined to be 17.6% using x-ray powder diffraction. No pure AgCl or AgBr phase was detected.

Example 9

AgClBr Ultrathin Tabular Grain Emulsion

This emulsion was prepared by a procedure similar to that of Example 8, except that 16.1 mmole per mole silver of 4,5,6-triaminopyrimidine were added.

The resulting tabular grain emulsion contained tabular grains having an average diameter of 5.27 μm, an average thickness of 0.039 μm (AFM) and an average aspect ratio of 135. The tabular grains accounted for greater than 95% of the projected area of the emulsion grains. The results are tabulated in Table II.

The amount of silver chloride incorporated into the silver halide grains was determined to be 17.4% using x-ray powder diffraction. No pure AgCl or AgBr phase was detected.

Example 10

This example emulsion was prepared similarly as that of Example 5, except that the 2M NaBr solution was replaced by an aqueous 1.76M NaBr and 0.24M KI solution. The fine grain emulsion and the 4,5,6-triaminopyrimidine were heated at pH 7.0, pBr 3.38 for 1.5 hours at 60° C.

The resulting tabular grain emulsion exhibited a mean ECD of 0.74 μm, an average grain thickness of 0.026 μm and an average aspect ratio of 28. The tabular grains accounted for greater than 90 percent of total grain projected area. The results are summarized in Table II.

The amount of iodide incorporated in the tabular grains was determined using x-ray powder diffraction. The emulsion consisted of a single silver halide phase that was 12.1 mole per iodide, based on silver. Examination of the grains by transmission electro microscopy revealed that they were free of triations, indicating that they were free of microscopic nonuniformities of the type described in EPO 0 326 853 and references cited therein.

Control 11

This control emulsion prepared by a procedure similar to that of Example 8, except triaminopyrimidine was not added. The resulting emulsion contained nontabular grains having an average diameter of 0.08 μm. No tabular grains were found.

TABLE II

| Emulsion | Halide | Average Tabular Thickness (μm) | Average Tabular Diameter (μm) | Average Aspect Ratio | % Projected Area as Tabular |
|---|---|---|---|---|---|
| Example 2 | AgBr | 0.024 | 2.1 | 88 | >95% |
| Example 3 | AgBr | 0.022 | 0.70 | 32 | >95% |
| Example 4 | AgBr | 0.035 | 10.0 | 286 | >95% |
| Example 5 | AgBr | 0.026 | 2.0 | 77 | >95% |
| Example 6 | AgBr | 0.022 | 1.61 | 73 | >95% |
| Example 7 | AgIBr (3% 1) | 0.030 | 1.33 | 44 | >95% |
| Example 8 | AgClBr (17.6% Cl) | 0.033 | 5.84 | 177 | >95% |
| Example 9 | AgClBr (17.4% Cl) | 0.039 | 5.27 | 135 | >95% |
| Example 10 | AgIBr (12% Cl) | 0.026 | 0.74 | 28 | >90% |

The invention has been described in detail with particular reference to preferred embodiments thereof, but it will be understood that variations and modifications can be effected within the spirit and scope of the invention.

What is claimed is:

1. A grain growth process for providing a tabular grain emulsion in which the equivalent circular diameter of tabular grains is increased while maintaining their thickness at less than 0.07 μm comprising (1) providing an aqueous dispersion containing at least 0.1 percent by weight silver in the form of silver halide seed grains containing at least 50 mole percent bromide having an average thickness of less than 0.06 μm, the dispersion having a pH in the range of from 4.6 to 9.0 and a stoichiometric excess of bromide ions to silver ions limited to a pBr of at least 1.5, (2) introducing into the dispersing medium a triaminopyrimidine grain growth modifier containing mutually independent 4, 5 and 6 ring position amino substituents, the 4 and 6 ring position substituents being hydroamino substituents, and (3) holding the aqueous dispersion containing the triaminopyrimidine grain growth modifier at a temperature of at least 15° C. until the average equivalent circular diameter of the seed grains remaining has increased at least 0.1 μm and greater than 50 percent of total grain projected area is accounted for by tabular grains having {111} major faces and an average thickness of less than 0.07 μm.

2. A grain growth process according to claim 1 wherein greater than 50 percent of the total grain projected area of the seed grains provided in step (1) is accounted for by tabular grains having {111} major faces.

3. A grain growth process according to claim 2 wherein the thickness of the tabular grains is increased by less than 0.01 μm in step (3).

4. A grain growth process according to claim 1 wherein greater than 50 percent of the total projected area of the seed grains is accounted for by nontabular grains.

5. A grain growth process according to claim 4 wherein the seed grains are provided by a Lippmann emulsion.

6. A grain growth process according to claim 1 wherein the seed grains additionally contain iodide.

7. A grain growth process according to claim 1 wherein the seed grains additionally contain chloride.

8. A grain growth process according to claim 1 wherein the pH is in the range of from 5.0 to 8.

9. A grain growth process according to claim 1 wherein the triaminopyrimidine grain growth modifier satisfies the formula:

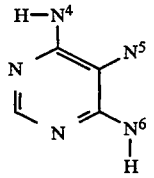

where $N^4$, $N^5$ and $N^6$ are independent amino moieties.

10. A grain growth process according to claim 9 wherein $N^4$ and $N^6$ represent primary or secondary amino groups and $N^5$ represents a primary, secondary or tertiary amino group.

11. A grain growth process according to claim 10 wherein the triaminopyrimidine satisfies the formula:

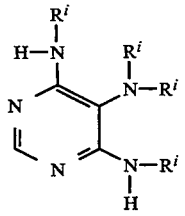

where $R^i$ is independently in each occurrence hydrogen or alkyl of from 1 to 7 carbon atoms.

12. A grain growth process according to claim 7 wherein $R^i$ is in each occurrence hydrogen.

13. A grain growth process according to claim 1 wherein the triaminopyrimidine is selected from among 4,5,6-triaminopyrimidine,
5,6-diamino-4-(N-methylamino)pyrimidine,
4,5,6-tri(N-methylamino)pyrimidine,
4,6-diamino-5-(N,N-dimethylamino)pyrimidine and
4,6-diamino-5-(N-hexylamino)pyrimidine.

14. A grain growth process according to claim 1 wherein the triaminopyrimidine is present in the aqueous dispersion in a concentration ranging from 0.1 to 500 millimoles per silver mole.

15. A grain growth process according to claim 1 wherein the dispersing medium exhibits a pBr of at least 2.0.

16. A grain growth process according to claim 15 wherein the dispersing medium exhibits a pBr of greater than 2.6.

17. A grain growth process according to claim 1 wherein the dispersing medium contains from 0.1 to 20 weight percent silver.

18. A grain growth process according to claim 17 wherein the dispersing medium contains from 0.5 to 10 weight percent silver.

19. A grain growth process for providing a tabular grain emulsion in which the equivalent circular diameter of tabular grains is increased while maintaining their average thickness at less than 0.07 μm comprising (1) providing an aqueous dispersion containing from 0.1 to 20 percent by weight silver in the form of a tabular grain emulsion containing at least 50 mole percent bromide in which greater than 50 percent of total grain projected area is accounted for by tabular grains having {111} major faces and an average thickness of less than 0.06 μm, the dispersion having a pH in the range of from 5.0 to 8.0 and a stoichiometric excess of bromide ions to silver ions limited to a pBr of at least 2.0;

(2) introducing into the dispersing medium a triaminopyrimidine grain growth modifier selected from among
4,5,6-triaminopyrimidine,
5,6-diamino-4-(N-methylamino)pyrimidine,
4,5,6-tri(N-methylamino)pyrimidine,
4,6-diamino-5-(N,N-dimethylamino)pyrimidine and
4,6-diamino-5-(N-hexylamino)pyrimidine in a concentration ranging from 0.4 to 200 millimoles per silver mole;

(3) holding the aqueous dispersion containing the triaminopyrimidine grain growth modifier at a temperature of from 20° to 90° C. until the average equivalent circular diameter of the tabular grains has increased at least 0.5 μm while the thickness of the tabular grains has increased less than 0.01 μm.

20. A grain growth process for providing a tabular grain emulsion in which the tabular grains have an average thickness of less than 0.07 μm comprising (1) providing an aqueous dispersion containing from 0.1 to 20 percent by weight silver in the form of a Lippmann emulsion containing at least 50 mole percent bromide having an average thickness of less than 0.06 μm, the dispersion having a pH in the range of from 5.0 to 8.0 and a stoichiometric excess of bromide ions to silver ions limited to a pBr of at least 2.0;

(2) introducing into the dispersing medium a triaminopyrimidine grain growth modifier selected from among
4,5,6-triaminopyrimidine,
5,6-diamino-4-(N-methylamino)pyrimidine,
4,5,6-tri(N-methylamino)pyrimidine, 4,6-diamino-5-(N,N-dimethylamino)pyrimidine and 4,6-diamino-5-(N-hexylamino)pyrimidine in a concentration ranging from 0.4 to 200 millimoles per silver mole;

(3) holding the aqueous dispersion containing the triaminopyrimidine grain growth modifier at a temperature of from 20° to 90° C. until greater than 70 percent of total grain projected area is accounted for tabular grains having {111} major faces and an average thickness of less than 0.07 μm.

* * * * *